United States Patent [19]

Repik et al.

[11] 4,002,533

[45] Jan. 11, 1977

[54] TWO-STEP PROCESS FOR CONDITIONING SIZED COAL AND RESULTING PRODUCT

[75] Inventors: Albert J. Repik, Charleston; Charles E. Miller, Mount Pleasant; Homer R. Johnson, Charleston, all of S.C.

[73] Assignee: Westvaco Corporation, New York, N.Y.

[22] Filed: May 9, 1974

[21] Appl. No.: 468,616

Related U.S. Application Data

[63] Continuation-in-part of Ser. No. 269,300, July 6, 1972, abandoned.

[52] U.S. Cl. ..... 201/1; 201/8; 201/9; 201/31; 201/36; 201/42; 201/44; 252/445

[51] Int. Cl.[2] ..... C10L 9/06

[58] Field of Search ..... 201/9, 31, 8, 36, 31, 201/44, 1, 42, 39; 252/421, 445; 48/210

[56] References Cited

UNITED STATES PATENTS

| | | | |
|---|---|---|---|
| 2,805,189 | 9/1957 | Williams | 202/14 |
| 3,047,472 | 7/1962 | Gorin | 202/9 |
| 3,070,515 | 12/1962 | Sylvander | 202/25 |
| 3,444,046 | 5/1969 | Harlow | 201/6 |
| 3,574,065 | 4/1971 | Eddinger | 201/12 |
| 3,712,855 | 1/1973 | Allred | 201/6 |
| 3,843,559 | 10/1974 | Repik | 201/31 |

FOREIGN PATENTS OR APPLICATIONS

| | | | |
|---|---|---|---|
| 680,497 | 10/1952 | United Kingdom | 201/9 |

*Primary Examiner*—Hiram H. Bernstein
*Attorney, Agent, or Firm*—Richard L. Schmalz; Ernest B. Lipscomb, III

[57] ABSTRACT

An improved two-step fluid bed process for conditioning sized, agglomerative, high volatile bituminous coal is disclosed. The agglomerative bituminous coal is first crushed and sized for fluidization. A first treatment is conducted under oxidizing conditions at below the fusion temperature of the coal, preferably at about 600° F., followed immediately by a second treatment under a non-oxidizing or inert atmosphere at preferably 800° F. ±50° F. The resulting oxidized and heat treated coal particles have a volatile content of at least 15% and are thereby rendered non-agglomerative when thereafter subjected to even higher temperatures, e.g., when making activated carbon and/or synthesis gas.

6 Claims, 2 Drawing Figures

TWO-STEP PROCESS FOR CONDITIONING SIZED COAL AND RESULTING PRODUCT

CROSS-REFERENCE TO RELATED APPLICATION

This application is a continuation-in-part of co-pending U.S. application Ser. No. 269,300 filed July 6, 1972, and now abandoned.

BACKGROUND OF THE INVENTION

1. Field of the Invention

This invention relates generally to a two-step process for treating sized agglomerative coal particles preliminary to its use for making activated carbon and/or synthesis gas. More particularly, this invention relates to a process for oxidizing and heat treating agglomerative bituminous coal to render it non-agglomerative and to the resulting products.

2. Description of the Prior Art

Coal has traditionally been valued for its fuel content. More recently, there has been an increased demand for its value as a raw material for such products as activated carbon decolorents an absorbents, activated charcoal, and the like. Additionally, with increasing shortages of domestic natural gas, the demand has grown for substituting synthesis gas for natural gas using coal as the starting raw material. In the aforementioned industrial applications, or products where coal is the starting raw material, it is generally necessary to first prepare the coal for processing by conventional washing, crushing and sizing techniques. Thereafter, the coal particles are heated in an oxidizing atmosphere to an elevated temperature. For instance, where the final product is activated carbon, various procedures have been proposed employing a variety of conditions whereby the volatile material contained in the coal is distilled therefrom and either recovered for its value as a source of hydrocarbons or discarded or burned. The remaining carbon can thereafter be activated using steam or any of the other well-known activating agents.

It is already known that bituminous coal particles become plastic-like and stick together when heated to 800° F., or thereabouts depending on the type of coal used, particle size, etc. This "agglomerative" effect is caused for the most part by the presence of tars and other volatiles present in the raw coal. The temperature at which the coal particles agglomerate is the "fusion temperature". This undesirable characteristic is particularly troublesome where fluidized bed reactors are employed. As particles clump and grow larger, the fluid reactor can become plugged and must be cleaned. Moreover, as the particles grow larger, it becomes more difficult to maintain the particles in a fluidized condition which is necessary for efficient reaction.

Various suggestions have heretofore been made for treating high volatile coal. For example, U.S. Pat. 3,047,472 to Gorin discloses a method for making char from coal wherein a preoxidation treatment of the crushed coal is carried out at a temperature ranging from 600° F. to 850° F. followed by a second oxidation at a temperature in excess of 850° F.

Similarly, U.S. Pat. 3,076,751 to Minet discloses a two-step process for making char and recovering volatiles from coal. In this process, however, it is noted that an inert gas is used in a first fluid bed reactor, maintained at a temperature which can be as high as 1600° F.

U.S. Pat. Nos. 3,375,175 and 3,565,766, both to Eddinger et al., discloses multi-stage fluid bed processes for pyrolyzing bituminous coal to obtain increased yields of oils and tars. As in the 3,076,751 patent, an inert gas is employed as the fluidizing medium in both the initial pretreatment and higher temperature pyrolysis. An oxidizing fluidizing medium is not employed until partial gasification in stage 4 is reached where the temperature is at least 1500° F.

U.S. Pat. No. 2,805,189 to Williams discloses a process for oxidation of coal followed by carbonization. While U.S. Pat. No. 3,444,046 to Harlow suggests a process having two oxidizing steps for making metallurgical quality coke.

However, as will be apparent hereinafter, none of the aforementioned prior art techniques suggests the two-step, oxidation and heat treatment process and resulting improved product of the present invention. Nor do any of the techniques suggested by the prior art recognize the advantages which accrue from the practice of this invention.

SUMMARY OF THE INVENTION

Figure 1:
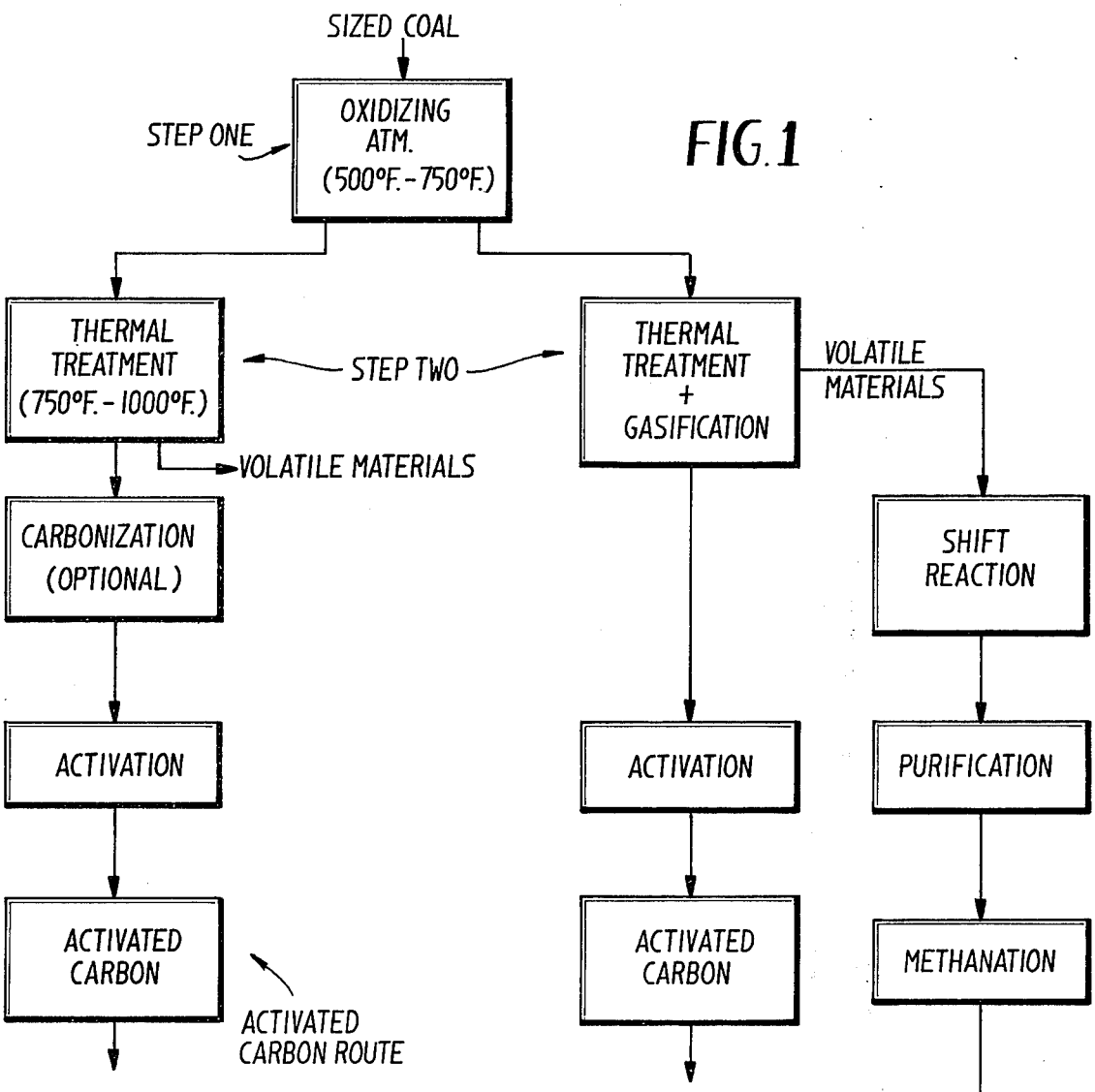
FIG. 1 is a block diagram illustrating two processes which utilize the two-step conditioning process and resulting product according to the present invention.

Broadly stated, the process according to the present invention relates to the treatment of sized agglomerative coal particles at relatively low temperatures preparatory to its employment as a starting material for making activated carbon, charcoal, synthesis gas, or the like. In particular, the process according to this invention comprises a two-step procedure whereby sized agglomerative coal particles are first subjected to an oxidizing, fluidizing gas at a temperature preferably in excess of about 500° F., but less than the fusion temperature of the coal, preferably below 750° F., followed immediately by a thermal treatment in an inert (non-oxidizing) fluidizing gas at a still higher temperature, preferably in excess of 750° F. but less than 1000° F. The coal particles are rendered non-agglomerative and have a volatile content of at least 15%.

Another essential aspect of this invention is the employment of water spray to control more precisely the temperature of the oxidation fluid bed reactor when the heat is liberated to a range within ±5° F.

It has been noted that in prior references relating to coal treatments, identical terminology has been used to describe completely different procedures or treatments. To avoid unnecessary confusion as to significance of this invention, emphasis will be placed on its application for producing activated carbon and/or synthesis gas. It is to be understood, however, that the present invention is equally well suited to other products derived from sized coal.

In one preferred technique for making activated carbon according to the present invention, the following basic steps are used:

a. preparing coal for fluidization by crushing and sizing;

b. oxidation and thermal treatment to prevent agglomeration;

c. carbonization (optional), activation; and d. acid washing, when necessary to remove ash.

Referring to the foregoing background material, it will now be appreciated that the present invention is directed solely to the oxidation-thermal treatment (step (b)) whereby the agglomerative tendencies of sized coal are eliminated and whereby improved product quality and yield are obtained.

ADVANTAGES OF THE INVENTION

At least four significant advantages were unexpectedly observed when conditioning sized coal particles according to the two-step oxidation-thermal treatment of the present invention:

1. The resulting particles were rendered non-agglomerative and could readily be employed as a raw material for making activated carbon or synthesis gas, in fluidized bed reactors at elevated temperatures, on the order of 1800° F. – 2000° F., without frequent shutdown of the fluid reactors;

2. There was a substantial improvement in the quality of the resulting particles. For example, the thus treated particles retained their original irregular shape and were harder than the rounded, soft and much less dense products obtained heretofore. These qualities are important for resisting abrasion while in a fluidized state;

3. A significant increase in the solid product yield was obtained. Thus, whereas product yields of 70–75% were obtained from a one-step process, yields as high as 89.8% were obtained with the two-step process of the present invention. It is believed that the increase in yield is due primarily from a decrease in fixed carbon burn-off rate, e.g., 0.3–0.5 pounds per hour per square foot of reactor cross-sectional area at 600° F. This is about one-tenth of the burn-off rate at 800° F. Another factor, although of lesser significance than the former, which contributes to the improved yield is believed to reside in the ability of the particles to resist abrasion and therefore degradation by attrition under fluidizing conditions;

4. An increase in the amount of volatile material recovered; and

5. The oxidizing step is more compatible with fluid bed equipment through the use of the water spray to control the exothermal heat of reaction within ±5° F.

It will therefore be appreciated that the foregoing advantages offer significant technical, as well as, economic benefits over conventional processes for making activated carbon and/or synthesis gas and for recovering organic materials from coal.

DETAILED DESCRIPTION OF THE INVENTION

The coal found to be most desirable for use in the process of this invention is referred to as high volatile agglomerating bituminous coal. Typically, such coals are designated as A, B, C types, which according to A.S.T.M. classification contain less than about 70% dry fixed carbon and more than about 30% dry volatile matter. High volatile coals which can be advantageously employed are widely distributed throughout the United States, e.g., West Virginia, Kentucky, Ohio, Pennsylvania, Illinois, New Mexico, etc. Reference is made to the publication "Chemistry of Coal Utilization", by Lowry, Chap. 2, (John Wiley and Sons, N. Y., 1945) for a more complete description of the various coal classification systems. The sized coal employed has a particle size which ranges from about 6 mesh to about 325 mesh, with 12 mesh to 40 mesh being preferred.

Referring now to FIG. 1, it is seen that the two-step process according to the present invention can be incorporated in at least two different industrial applications. The particular route taken depends of course on the end product desired, i.e., activated carbon, synthesis gas, or a combination of the two.

Where the product sought is activated carbon, coal, preferably bituminous, is crushed and sized using conventional equipment with one or more washing steps in between operations to obtain a particle size range, generally smaller than 6 mesh, suitable for fluidization. The sized particles are fluidized in a reactor maintained under an oxidizing atmosphere at a temperature below the fusion temperature of the coal, preeferably at about 600° F., to initiate volatilization of organic substances in the coal. The particles are then subjected to a second fluidizing thermal treatment under an inert atmosphere, preferably maintained at about 800° F., wherein the sized particles are rendered non-agglomerating.

Carbonization is optionally included after thermal treatment and is generally carried out at temperatures exceeding 1000° F. to remove all or any portion of remaining organic material from the carbonaceous structure and to render the structure more suitable for activation.

The activation step, as indicated above, can immediately follow either thermal treatment, or carbonization if it is employed. Generally, activation is carried out at about 1700–1800° F. with steam or a suitable oxygen containing gas as the activating agent. Although the precise mechanism for activation is not fully understood, the result of such a procedure is to substantially increase the porosity and surface area of the carbon rendering the structure highly adsorptive.

As earlier stated, the end product sought dictates which of the particular routes shown in FIG. 1 is to be taken. Where the product sought is primarily synthesis gas with lesser amounts of activated carbon being desired, the route shown at the right-hand portion of FIG. 1 is taken. Where the non-agglomerative particles are subjected to a gasification reaction in the presence of steam at about 1800° F., the significant gasificaton reactions are, as follows:

$$C + O_2 = CO_2 \quad (1)$$

$$C + H_2O = CO + H_2 \quad (2)$$

$$C + 2H_2 = CH_4 \quad (3)$$

It should be understood that total gasification of the inlet carbonaceous material can be effected, or, a partial gasification of the inlet material can be carried out with the non-gasified portion being optionally recovered as activated carbon. The particular ratios of solids to gases recovered will depend on economic factors such as the market values of the recovered products.

The recovered gaseous gasification products are then subjected to a series of operations designed to increase the methane content of the gas. Thus, in the shift reaction carbon monoxide is reacted with steam in the presence of a suitable catalyst to form carbon dioxide and additional hydrogen. Removal of sulfur compounds and carbon dioxide in the gas is carried out in the purification step prior to methanation where remaining carbon monoxide is converted to methane in the presence of hydrogen and a suitable catalyst. This procedure yields a gaseous product comprising substantially all methane. However, synthesis with lesser percentages can also be obtained by deleting and/or modifying one or more of the aforementioned steps.

Figure 2:
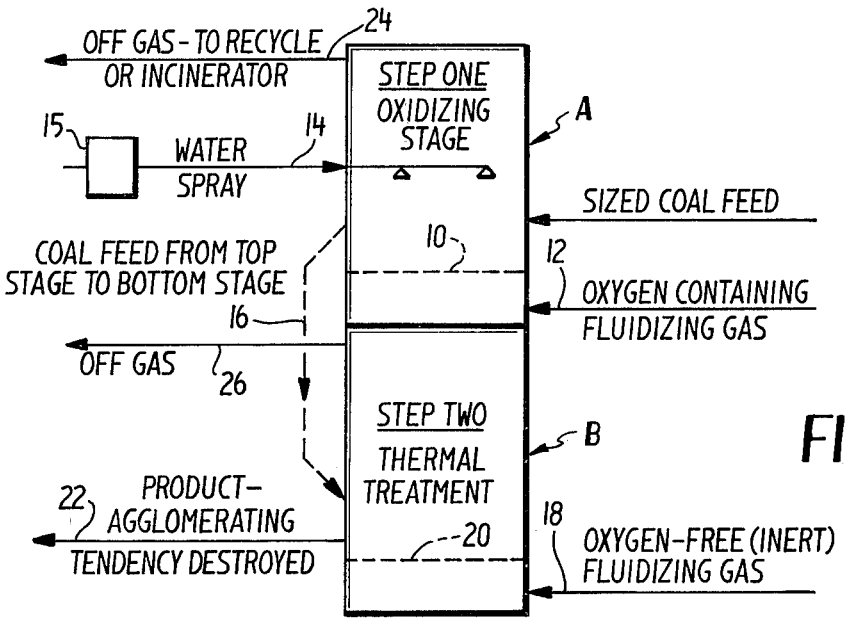
FIG. 2 is an expanded schematic illustration of the two-step oxidation-thermal treatment in a fluidized bed.

In FIG. 2, the two-step conditioning process according to the present invention is schematically illustrated in somewhat greater detail than in FIG. 1. The sized coal is introduced in fluid reactor A provided with a perforated coal support plate 10 and kept in a fluidized state by the upwardly directed oxygen-containing gas 12. The percentage of oxygen in the fluidizing gas is not critical and can be widely varied. Good results have been obtained with gases containing up to about 21% oxygen by volume. For economy reasons, air is employed (20.8% oxygen) although nitrogen mixtures with lesser or greater concentrations of oxygen can also be used.

The bed temperature of reactor A is advantageously maintained at about 600° F. ±5° F. by a water spray 14 positioned in the reactor. Automatic temperature sensing means (not shown) offers a most effective way of controlling the addition of cooling water to remove exothermal heat liberated during the oxidation of the particles. For example, a suitable thermocouple electrically connected to a temperature controller can be employed to actuate a valve 15, e.g., electrically or pneumatically operated. Or, valve 15 can be manually controlled, if desired. It has been found that the direct injection of liquid water into the solid/gas mixture in the reactor A is extremely effective in controlling the reaction temperature. This results from the high rate of heat transfer between the liquid injected and the solid/-gas mixture and the relatively high heat of vaporization of water (about 1000 BTU/lb.). Moreover, by using a direct cooling method, substantial economics can be effected. This includes lower capital investment and operating costs. Expensive heat exchange devices can be eliminated. By directly injecting water, the reaction temperature can be kept within a few degrees, ±5%, of the desired temperature.

The average residence time of the coal particles in the reactor can vary widely depending on such factors as the type of coal employed, the percentage of oxygen in the fluidizing medium, the moisture content and the like. Generally, an average residence time of up to one hour or more is sufficient to achieve the desired results. Thus, for example, coal particles leaving the fluid reactor A have an oxygen pickup value ranging from about 0.1 to about 0.25 pounds oxygen per pound of coal and a dry volatile content generally between 30 and 35%. Thus, little, if any, volatiles are driven off during oxidation. The oxygen pickup value signifies the amount of oxygen consumed by reaction and absorption. Although the oxygen pickup occurs at 500° F. or so, it is important to note that coal particles leaving the fluid bed reactor A still retain their agglomerating characteristic, as evidenced by a low oxidation number, e.g., 5–10, as will be described in greater detail hereinafter.

The amount of oxygen pickup is an essential parameter in obtaining a non-agglomerating coal. The oxygen pickup followed by the thermal treatment discussed below corresponds roughly to oxidation number in the following manner.

| Oxygen Pickup lb./lb. Coal Followed by Thermal Treatment | Oxidation Number |
|---|---|
| 0.01 | 13 |
| 0.02 | 28 |
| 0.04 | 50 |
| 0.06 | 68 |
| 0.10 | 90 |
| 0.16 | 90+ |
| 0.20 | 90+ |
| 0.25 | 90+ |

An Oxidation Number of 90 or greater signifies acceptable agglomerating properties. On the other hand, the Free-Swelling Index (F.S.I.) as defined according to A.S.T.M. D-720-46 and used extensively in the literature relates approximately to the Oxidation Number in the following manner.

| Oxidation Number | F.S.I. |
|---|---|
| 0 – 10 | 1.5 – 9 |
| 10 – 90 | 1.0 – 1.5 |
| 90+ | <1* |

Note:
*The ground coal sample does not form a coke button when subjected to the test conditions so determining F.S.I.

It is, therefore, essential that the second part of the conditioning process of this invention is carried out under predetermined conditions to eliminate these agglomerating tendencies and yet maintain the desirable physical characteristics of the particles. The oxidized agglomerative particles from fluid reactor A are transported to fluidized reactor B through conduit 16, wherein thermal treatment accompanied by additional devolatilization of the particles is effected. The operating temperature of reactor B is advantageously maintained from about 750° F. to about 1,000° F., and most preferably at 800° F. Fluidizing gas 18 is introduced below perforated support plate 20 at the prescribed temperature. The fluidizing medium must be non-oxidizing in nature as, for example, steam, flue gas, nitrogen and the like. Since no further highly exothermic oxidation occurs in reactor B, there is no necessity for cooling means, direct or indirect, as provided for in reactor A. The average residence time of coal particles treated in reactor B can vary widely depending on the nature and size of particles being treated, etc., as earlier stated with regard to reactor A. Generally, an average residence time of from about 10 minutes to one hour or so has been found sufficient to render the particles non-agglomerative. The time, of course, can be lengthened when necessary, but not so long as to drive off a substantial amount of the volatiles. In fact, it has been found that the heat treatment may render the particles non-agglomerative and have at least 15% volatiles, and usually 24 to 28% volatile content when operating within the preferred 750° F. to 850° F. range. The thermal treatment of this process distinguishes low temperature carbonization which drive off substantial amounts of volatiles and graphitize the coal particles.

After contacting the coal particles, the fluidizing gases are directed out of the reactors A and B through conduits 24, 26, respectively, as an "off gas". The off gas can be recovered, stripped of the volatiles and re-used or discarded by burning or the like.

The solid product leaving reactor B through conduit 22 can be recovered for packaging as an intermediate product, or used directly in the activated carbon process or synthesis gas process shown in FIG. 1. This material is readily distinguishable as a non-agglomerative carbon having a hardness value and particle shape substantially comparable to the original sized coal feed. Furthermore, the apparent density of the product according to this invention ranges from about 35 to about 45 lb./ft.$^3$. Accordingly, this material possesses improved characteristics over materials produced by other methods. Thus, the product of the present invention is also useful as a starting raw material for making activated carbon and synthesis gas.

Having described the invention in general terms, the following examples are set forth with reference to the drawing to more particularly illustrate the invention. These examples are not meant to be limiting.

EXAMPLE 1

Sized C bituminous coal having a CWS (Chemical Warfare Service) hardness value of 63 and a volatile content of 35.7% was processed according to step 1 of the present invention in an 18 inch diameter steel fluid bed reactor (FIG. 2, reactor A) provided with a water spray under the following operating conditions:

| | |
|---|---|
| Coal particle size range: | 12 × 40 mesh (Tyler screen) |
| Fluidizing gas: | Flue gas with 10% oxygen |
| Bed temperature controlled with water: | 590° F. – 600° F. |
| Residence time: | 30 minutes |

The thus treated coal particles were found to possess good physical characteristics, had a dry volatile content of 33.6% but still retained their agglomerating tendency, as shown hereinafter in TABLE I.

EXAMPLE 2

Sized coal treated in accordance with the procedure set forth in Example 1 was further processed according to step 2 of the present invention in a 4 inch diameter steel fluid bed reactor (FIG. 2, reactor B) under the following operating conditions:

| | |
|---|---|
| Fluidizing gas: | Nitrogen (oxygen-free) |
| Bed temperature: | 800° F. – 850° F. |
| Residence time: | 30 minutes |

The thus treated particles which emerged were found to have outstanding physical and non-agglomerating characteristics and a volatile content of 25.8%, as shown hereinafter in Table I.

EXAMPLE 3

In this example, sized high volatile C bituminous coal identical to that used in Examples 1 and 2, was subjected to a one-step conditioning process to compare the results of same against the two-step process of the present invention. The operating conditions were as follows:

| | |
|---|---|
| Fluidizing gas: | Nitrogen with 10% oxygen |
| Bed temperature: | 800° F. |
| Residence time: | 30 minutes |

The emerging particles were found to be non-agglomerative. However, as shown in Table I hereinbelow, product yields and quality were not nearly as good as that obtained in Example 2.

TABLE I

COMPARATIVE RESULTS AFTER TWO DIFFERENT FLUID BED PROCESSES ARE USED IN PREPARING HIGH VOLATILE BITUMINOUS COAL FOR MAKING ACTIVATED CARBON

| | Untreated Coal | One-Step Process (Oxidation) | Two-Step Process (Present Invention) | |
|---|---|---|---|---|
| | | | Oxidation | Thermal Treatment |
| Solid Product Yield (%) | — | 75 | — | 89.8 |
| Apparent Density (lbs./ft.$^3$) | 47 | 25 | — | 41.6 |
| Oxygen Pickup (lb./lb. coal) | — | 0.25 | 0.25 | 0 |
| Oxidation Number | 0 | 90+ | 10 | 90+ |
| Particle Shape | Irregular | Became Spherical | Unchanged | Unchanged |
| CWS Hardness Number[1] | 63 | 37 | — | 63 |
| F.S.I. | 4.8 | <1 | 1 – 1.5 | <1 |
| Volatile Content | 35.7 | 24.8 | 33.6 | 25.8 |
| Agglomerating | Yes | No | Yes | No |

[1]The CWS (Chemical Warefare Service) hardness number is an indication of the resistance of coal particles to degradation by the action of steel balls in a Ro-Tap machine as set forth in Military Specification Document-MIL-C-13724A, dated 4 May 1960.

From the results shown in Table I, it will be clear that the present invention is superior to the prior art processes and is an improvement over the one-step oxidation method with respect to economic considerations such as yield and quality improvement in the particle physical characteristics.

It should be appreciated that the present invention is not to be construed as being limited by the illustrative embodiments. It is possible to produce still other embodiments without departing from the inventive concepts herein disclosed. Such embodiments are within the ability of one skilled in the art.

What is claimed is:

1. A process for conditioning high volatile coal particles to be used for making activated carbon or obtaining a synthesis gas consisting essentially of:

a. sizing the coal to a particulate size in the range of 6 to 325 mesh;

b. fluidizing said sized high volatile coal particles with an oxidizing medium containing from about 2% to about 21% oxygen by volume at a temperature in excess of about 500° F. but less than the fusion temperature of said coal particles for from about 10 minutes to 1 hour until the particles have an oxygen pickup value of from about 0.1 to about 0.25 pounds of oxygen per pound of coal, which is insufficient to render the particles non-agglomerative;

c. spraying water directly onto said fluidized coal particles being oxidized for maintaining the oxidizing temperature within ±5° F. of the desired temperature; and d. fluidizing said oxidizing particles in a non-oxidizing atmosphere and thermally treating the particles at a temperature in excess of about 750° F. but less than about 1,000° F. to render said particles non-agglomerative and having at least 15% by dry weight of volatiles.

2. The process according to claim 1 wherein means for sensing the oxidation temperature are provided, said temperature sensing means automatically controlling the addition of said spray water.

3. The process according to claim 1 wherein the temperature during said oxidation step is maintained from about 550° F. to about 650° F., and said thermal treatment step temperature is maintained from about 750° F. to about 850° F.

4. The process according to claim 1 wherein the average particle residence time in said oxidation step is from about 10 minutes to 1 hour and the average particle residence time during thermal treatment step is from about 5 minutes to about 1 hour.

5. The process according to claim 1 further comprising the steps of:

e. carbonizing said non-agglomerative coal particles; and f. activating said carbonized particles to form activated carbon.

6. The process according to claim 1 further comprising the step of:

g. gasifying said non-agglomerative coal particles to recover a synthesis gas.

* * * * *